United States Patent [19]

Steinhof et al.

[11] 4,125,002

[45] Nov. 14, 1978

[54] PATTERNING DEVICE FOR A MANUAL KNITTING MACHINE

[76] Inventors: Dieter Steinhof, Bismarckstr. 28, 8135 Söcking; Winfried Krämer, Köslinerstr. 5a, 1000 Berlin, both of Fed. Rep. of Germany

[21] Appl. No.: 832,985

[22] Filed: Sep. 13, 1977

[30] Foreign Application Priority Data

Sep. 13, 1976 [DE] Fed. Rep. of Germany ..... 2641151

[51] Int. Cl.[2] ..... D04B 7/00; D04B 15/66

[52] U.S. Cl. ..... 66/75.2; 66/154 A

[58] Field of Search ..... 66/75.2, 154 A, 50

[56] References Cited

U.S. PATENT DOCUMENTS

| | | | |
|---|---|---|---|
| 3,820,359 | 6/1974 | Hanson | 66/50 A |
| 3,899,899 | 8/1975 | Bartels | 66/75.2 |
| 4,015,446 | 4/1977 | Kagaya | 66/75.2 |

FOREIGN PATENT DOCUMENTS

| | | | |
|---|---|---|---|
| 2,559,545 | 4/1976 | Fed. Rep. of Germany | 66/75.1 |

*Primary Examiner*—Ronald Feldbaum

*Attorney, Agent, or Firm*—McNenny, Pearne, Gordon, Gail, Dickinson & Schiller

[57] ABSTRACT

A sampling device is disclosed for a manual knitting machine having a sampling wheel which is synchronized, via drag links including sampling teeth, with the rotational movement of a selection disc. The drag links are actuated through a leaf spring and L-shaped rocker lever arrangement under the control of a switching magnet to cause the drag links and sampling teeth to move into their operating position. The sampling device and drag links are arranged to avoid inadvertent operation due to centrifugal forces developed during the rotational operation of the device.

6 Claims, 2 Drawing Figures

Figures 1, 2:
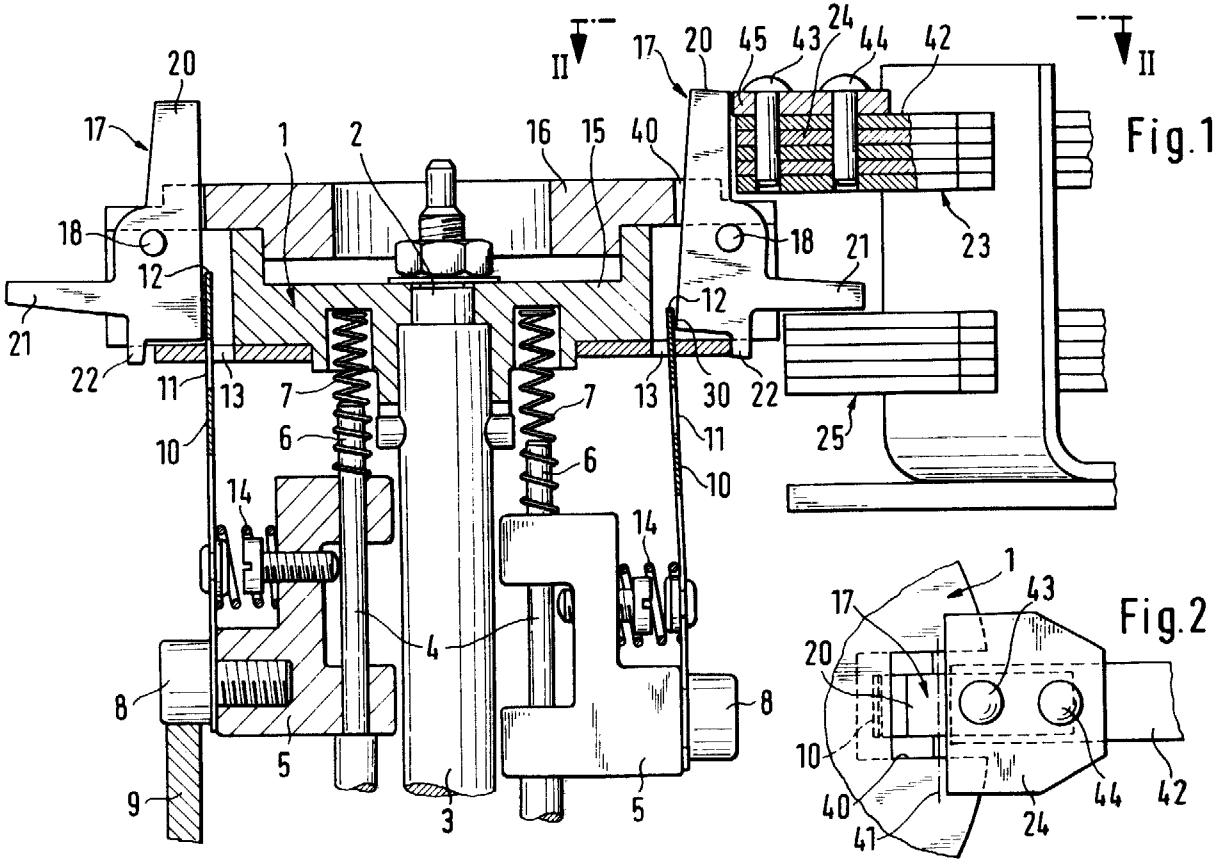

II
II
1
2
3
4
5
6
7
8
9
10
11
12
13
14
15
16
17
18
20
21
22
23
24
25
30
40
41
42
43
44
45

PATTERNING DEVICE FOR A MANUAL KNITTING MACHINE

The invention relates to a patterning device for a manual knitting machine having a patterning wheel which depends upon the sliding movement thereof, the rotation of which is synchronised, via drag links or the like having patterning teeth, with the movement of a selection disc activated by a switching magnet, during which rotation the drag links or the like may be controlled by drop shoes affected by switching magnets via leaf spring components.

With patterning devices of this type, it is known to form the leaf spring components in such a way that they may be brought from their latching position into the operating position either by means of a single-pole switching magnet or by a two-pole switching magnet. Although it was advantageous to use two-pole switching magnets for certain types of patterning devices for manual knitting machines, it has been found that with manual knitting machines which operate particularly quickly and in which the selection disc is thus also subjected to rapid rotation, the centrifugal forces enable the leaf spring components to leave their latching positions automatically under certain circumstances.

The object of the invention is to ensure that the leaf spring components are only brought into the operating position by the switching magnet in the context of the selected sample and that the leaf spring components are definitely prevented from unlatching automatically.

The object is achieved in that, with a patterning device of the type mentioned at the beginning of this specification, the free ends of the leaf spring elements may be brought out of their latching position into the operating position by levers or the like which may be moved by the switching magnets.

This has the advantage that the leaf spring components are no longer brought into the operating position directly but by means of a lever and that it is thus impossible for the leaf spring components to unlatch automatically.

A preferred embodiment of the invention consists in designing the levers or the like as rocking levers which are each connected to a leaf spring component and are hinged to the selection disc.

When using a two-pole switching magnet, the rocking lever may be designed L-shaped and the two-poles of the switching magnet may engage in the two-arms of the rocking lever which run almost perpendicularly to each other. It is beneficial here for each arm of the rocking lever to project freely over the upper edge of the selection disc.

The leaf spring components are preferably provided with these additional springs for bringing into the latching position; the additional springs may consist of compression spiral springs fixed onto the drop shoes.

An exemplary embodiment of the invention is shown in the drawings.

FIG. 1 shows a longitudinal section through a patterning device with the device according to the invention, and FIG. 2 shows a view along line 2—2 of part of this device.

A patterning device of a manual knitting machine which is not shown in detail has a selection disc 1 which is rotatably mounted about an axle 2 and is rigidly fixed to a shaft 3.

The lower end of this shaft is in turn rigidly fixed to the patterning wheel (not shown). Drag links 4 are provided between the selection disc 1 and the patterning wheel and patterning teeth are arranged on the free ends (not shown) of the drag links 4. The drag links 4 are rigidly fixed to drop shoes 5.

The other free end 6 of the drag links 4 (for instance, twelve drag links, not showable in the longitudinal section of FIG. 1) which drag links are evenly distributed in a circle around the axis of rotation of the selection disc 1 and the sampling wheel are connected under spring tension to the selection disc 1 via pressure springs 7.

A roller 8 or the like is mounted so as to rotate freely on each drop shoe 5 associated with each drag link and can travel over a ramp 9 which is provided on the side of the patterning device. This ramp lifts the respective drag link 4 and thus the patterning teeth into the upper position; in other words, the corresponding patterning tooth does not engage with a butt of a knitting needle.

Leaf springs or leaf spring components 10 are fixed to the drop shoes 5 and have a rectangular recess 11. The free ends 12 of the leaf springs engage in the selection disc via a rectangular opening 13 and are shown in the left-hand side of FIG. 1 in the latching position; that is to say, the free end 12 of this leaf spring 10 is supported on the edge of the selection disc 1.

Pressure spiral springs 14 are provided between the drop shoes 5 and the leaf spring 10 and press the leaf spring radially outwards, thus into the latching position.

Rocking levers 17 are rotatably mounted about a hinge 18 in radial slits in the selection disc consisting of a bottom section 15 and a top section 16 inserted therein. This hinge, formed for example as a bolt, extends transversely to the radial slits and enables the lever 17 to rock slightly. The rocking lever 17 has an approximately vertical arm 20 and an approximately horizontal arm 21. In addition, an abutment or a stop 22 is provided on the rocking lever beneath the horizontal arm 21 and limits the rocking motion of the rocking lever by resting on the selection disc 1, as described in more detail below.

An electrical switching magnet 23 provided outside the region in which the selection disc rotates has an upper pole 24 and a lower pole 25. These poles act on the respective arm 20 and 21 of the rocking lever 17. The stop 22 now rests on the selection disc 1, as shown on the right-hand side of FIG. 1.

The corresponding pivoting motion or the tilting motion of the rocking lever produced by the poles 24 and 25 of the magnet causes the nose 30 of the rocking lever to shift the respective free end 12 of the corresponding leaf spring radially inwards and thus to bring it from the latching position shown on the left-hand side of FIG. 1 into the operating position.

By releasing the latch between the free end 12 of the leaf spring 10 and the selection disc 1, the respective drop shoe 5 is able to draw the corresponding drag link 4 downwards by its own weight; this descent is also caused by the compression spiral spring 7.

The hinge 18 of the respective rocking lever is arranged in relation to the two arms 20 and 21 or the total mass of the rocking lever so that centrifugal forces can never cause the rocking lever to rock; this rocking motion is only produced by the two poles 24 and 25 and the arms 20 and 21 arranged perpendicularly to each other. Thus the two poles of the switching magnet 23 act simultaneously on surfaces which are approximately perpendicular to each other.

FIG. 2 shows the respective recess 40 for each rocking lever 17 arranged to rock about the axis 41. The upper arm 20 of the rocking lever contacts one pole 24 as shown in FIG. 1, in other words, the switching magnet has brought the respective patterning teeth into the operating position. The pole 24 consists of several connected layers 42 which are held tightly together by bolts 43, 44 as shown in FIG. 1.

It can also be seen from FIG. 1 that the upper pole layer 45 formed as a layer of brass projects a small distance beyond the five layers of magnetic steel sheets thereunder. This allows an even more precise action on the rocking lever 17. The upper layer 45 is substantially wider than the layers 42 thereunder which are only formed as thin strips, as shown in FIG. 2.

We claim:

1. A patterning device for a manual knitting machine having a patterning wheel which is dependent upon the sliding movement thereof and whose rotation is synchronised via drag links or the like having patterning teeth with the movement of a selection disc, a switching magnet for activating the selection disc, drop shoes influenced by the switching magnet via leaf spring components for controlling the drag links or the like, characterised in that the leaf spring components include free ends arranged to be brought from their latching position into the operating position by means of levers or the like moved by the switching magnet.

2. A patterning device according to claim 1, characterised in that the levers or the like are formed as rocking levers which are each associated with a leaf spring component and hinged to the selection disc.

3. A patterning device according to claim 2, wherein the switching magnet is bipolar, characterised in that the rocking lever is designed L-shaped and that the two poles of the switching magnet engage in two arms of the rocking lever which run approximately perpendicularly to each other.

4. A patterning device according to claim 3, characterised in that each arm of the rocking lever projects freely over the upper edge of the selection disc.

5. A patterning device according to claim 1, characterised in that the leaf spring components are provided with additional springs which bring the leaf spring components into the latching position.

6. A patterning device according to claim 5, characterised in that the additional springs consist of compression spiral springs fixed to the drop shoes.

* * * * *